US009989196B2

(12) United States Patent
Hsu

(10) Patent No.: US 9,989,196 B2
(45) Date of Patent: Jun. 5, 2018

(54) ADJUSTABLE LED LAMP WITH ROTATABLE LED TUBES

(71) Applicant: DONGGUAN JIA SHENG LIGHTING TECHNOLOGY COMPANY LIMITED, Dongguan (CN)

(72) Inventor: Shui-sheng Hsu, Dongguan (CN)

(73) Assignee: DONGGUAN JIA SHENG LIGHTING TECHNOLOGY COMPANY LIMITED, DongGuan (CN)

( * ) Notice: Subject to any disclaimer, the term of this patent is extended or adjusted under 35 U.S.C. 154(b) by 8 days.

(21) Appl. No.: 15/228,916

(22) Filed: Aug. 4, 2016

(65) Prior Publication Data

US 2017/0299124 A1 Oct. 19, 2017

(30) Foreign Application Priority Data

Apr. 13, 2016 (CN) ..... 2016 2 0312426 U

(51) Int. Cl.
*F21K 9/20* (2016.01)
*F21V 21/116* (2006.01)

(52) U.S. Cl.
CPC ..... *F21K 9/20* (2016.08); *F21V 21/116* (2013.01)

(58) Field of Classification Search
CPC ..... F21K 59/20; F21V 21/116; E04H 12/2269
USPC ..... 362/367, 371, 372, 413, 419, 427, 452, 362/655, 656
See application file for complete search history.

(56) References Cited

U.S. PATENT DOCUMENTS 6,280,056 B1 * 8/2001 Dolan ..... F21S 6/008 362/249.1
7,896,568 B2 * 3/2011 Atkinson ..... E05D 5/125 248/160
9,046,256 B2 * 6/2015 Szprengiel ..... F21V 23/06
2008/0253138 A1 * 10/2008 Katz ..... F21V 21/30 362/427

* cited by examiner

*Primary Examiner* — Elmito Breval
*Assistant Examiner* — Michael Chiang
(74) *Attorney, Agent, or Firm* — Platinum Intellectual Property LLP

(57) ABSTRACT

The invention relates a LED lamp. The LED lamp includes: a sleeve; a female joint received in the sleeve; a pluggable connector rotatably connected to the sleeve; a LED tube connected to the pluggable connector; and a male joint received in the pluggable connector and engaging the female joint; wherein the pluggable connector is provided with a plurality of clips on an outer sidewall thereof extending towards the LED tube, the clip is provided with a protrusion, the sleeve defines an annular groove on an inner wall thereof, the protrusion is latched in the annular groove when the pluggable connector is inserted into the sleeve, thereby preventing the pluggable connector from disengaging from the sleeve.

8 Claims, 11 Drawing Sheets

ADJUSTABLE LED LAMP WITH ROTATABLE LED TUBES

FIELD OF THE INVENTION

The present disclosure relates to a LED lighting technology, more particularly, relates to a LED lamp.

BACKGROUND OF THE INVENTION

LED lamp has advantages of low power consumption and having a soft light, and is extensively applied to various lighting occasions. The existing LED lamp includes a substrate, the substrate is provided with a LED chip. The substrate is connected to a wiring point of a lamp holder via electric wires. When the lamp holder extends into a power supply, then the LED chip is powered on and emits light.

Other than an incandescence light bulb, or a fluorescent lamp, the LED chip has characteristic of emitting light toward a specified direction. Due to the limitation of the design structure of the existing LED lamp, once the LED lamp is assembled, the light emitting direction of the LED lamp is fixed and can not be adjusted according to a requirement, thereby lacking for flexibility.

Further, when the existing LED lamp is dismantled to perform a modeling transformation, the process can only be accomplished by adopting many assembly tools, wasting time and energy, and the labor cost is high.

SUMMARY OF THE INVENTION

Accordingly, it is necessary to provide a LED lamp which can adjust the light emitting direction flexibility, and facilitates to dismantle the LED lamp when a modeling transformation is required.

A LED lamp includes: a sleeve; a female joint received in the sleeve; a pluggable connector rotatably connected to the sleeve; a LED tube connected to the pluggable connector; and a male joint received in the pluggable connector and engaging the female joint; wherein the pluggable connector is provided with a plurality of clips on an outer sidewall thereof extending towards the LED tube, the clip is provided with a protrusion, the sleeve defines an annular groove on an inner wall thereof, the protrusion is latched in the annular groove when the pluggable connector is inserted into the sleeve, thereby preventing the pluggable connector from disengaging from the sleeve.

A LED lamp includes: an assembly bracket; a plurality of tube couplings rotatably connected to the assembly bracket; a sleeve fixed to an outer wall of the tube coupling; a female joint received in the sleeve; a pluggable connector rotatably connected to the sleeve; a LED tube connected to the pluggable connector; and a male joint received in the pluggable connector and engaging the female joint; wherein the pluggable connector is provided with a plurality of clips at an outer wall thereof extending toward the LED tube, the clip is provided with a protrusion, the sleeve defines an annular groove in an inner wall thereof, the protrusion is latched in the annular groove when the pluggable connector is inserted into the sleeve, thereby preventing the pluggable connector from disengaging from the sleeve.

In above described LED lamp, by virtue of the plurality of tube couplings which are rotatably connected to the assembly bracket, it is easy to perform a modeling transformation to the LED lamp, and by virtue of the pluggable connector which is rotatably connected to the sleeve, the LED tube which is connected to the pluggable connector rotating along the sleeve for 360 degrees can be achieved. The light emitting direction of the LED tube can be adjusted flexibility according to a requirement, and the disengaging of the pluggable connector and the LED tube is simple.

DETAILED DESCRIPTION OF THE EMBODIMENTS

In order to fully understand the invention, the specific steps and specific structures will be provided in the following description for illustrating the technical solution of the invention. The preferred embodiment of the invention is specifically described as follows. However, the invention may be practiced without necessarily being limited to these specific details.

Figure 1:
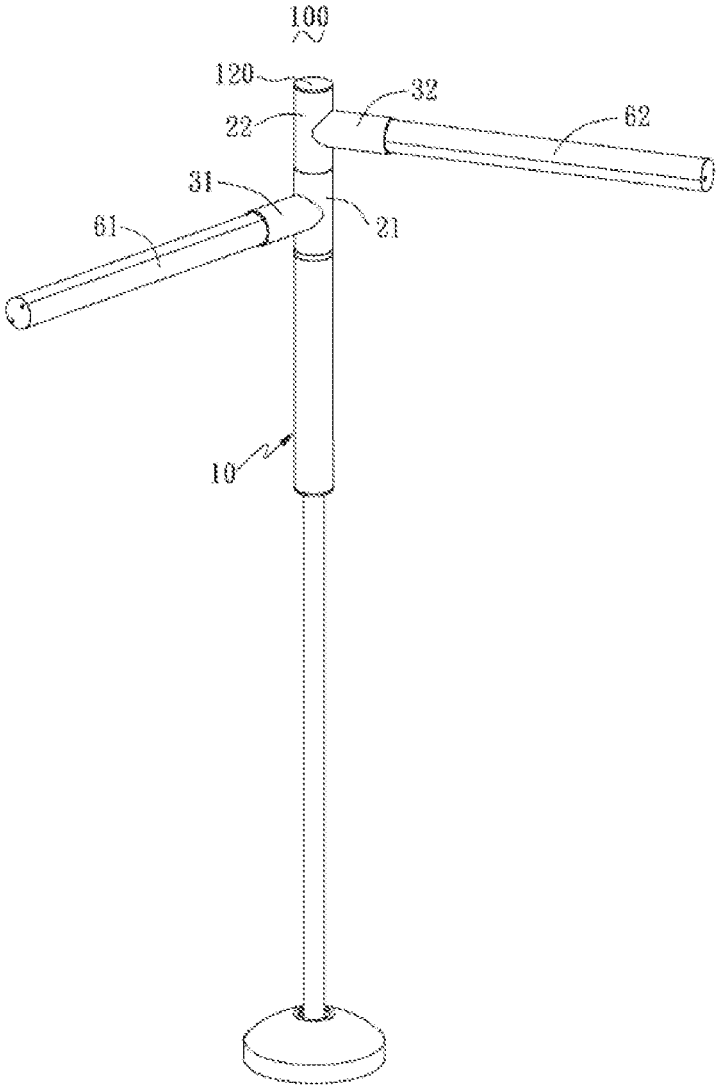
FIG. 1 is a schematic view of a LED lamp according to preferred embodiment of the invention.
Figure 2:
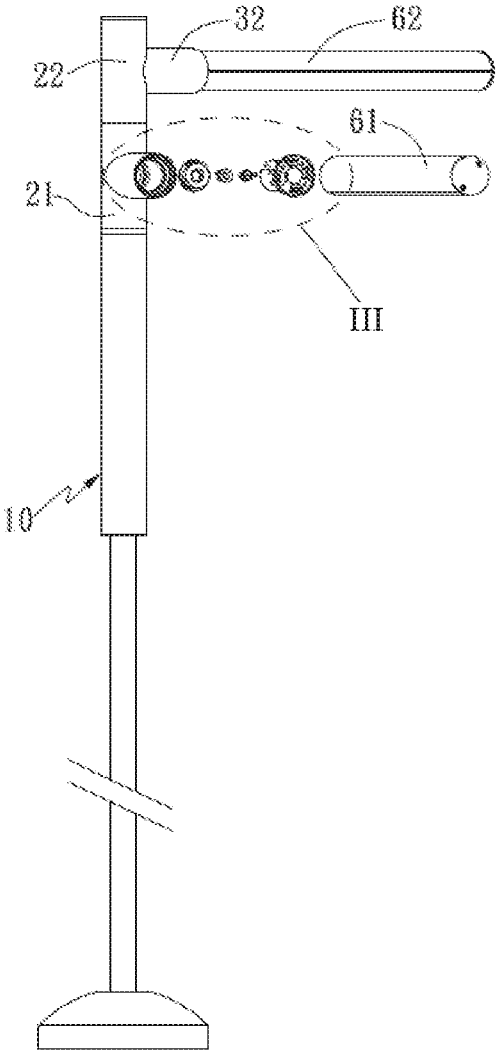
FIG. 2 is an exploded, schematic view of the LED lamp shown in FIG. 1.
Figure 3:
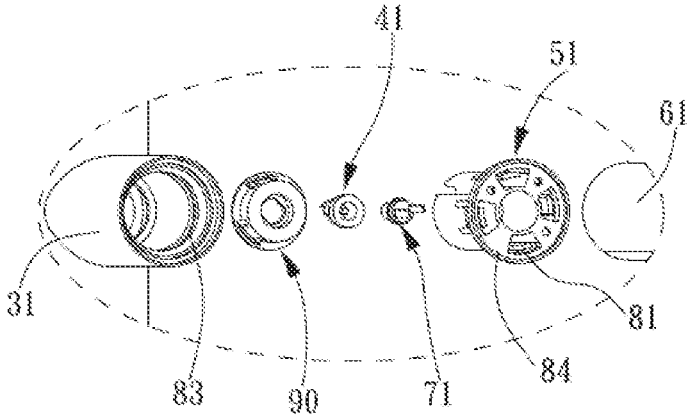
FIG. 3 is a enlarged view of circled portion III of FIG. 2.
Figure 4:
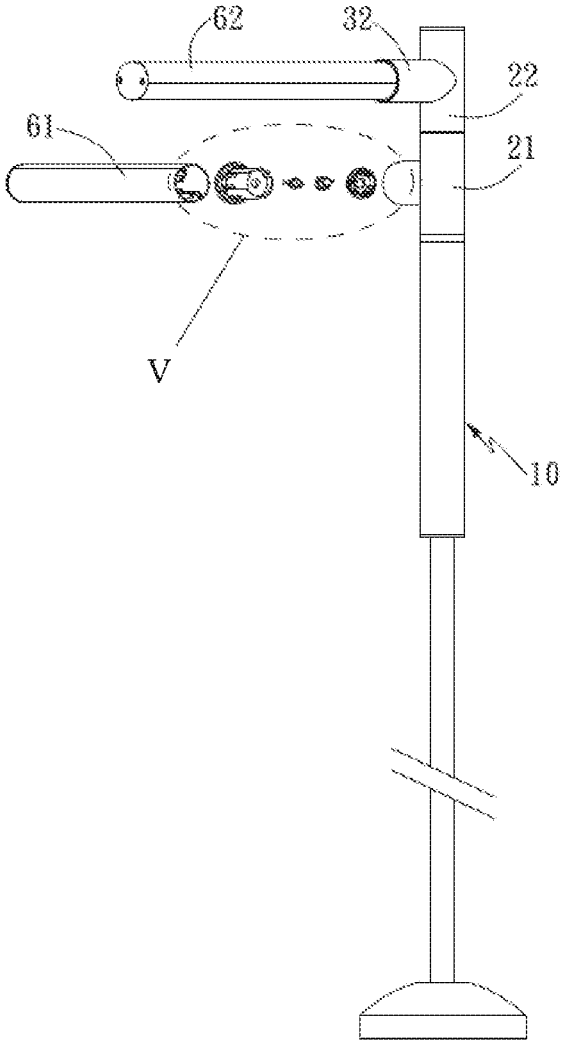
FIG. 4 is similar to FIG. 2, but viewed from another aspect.
Figure 5:
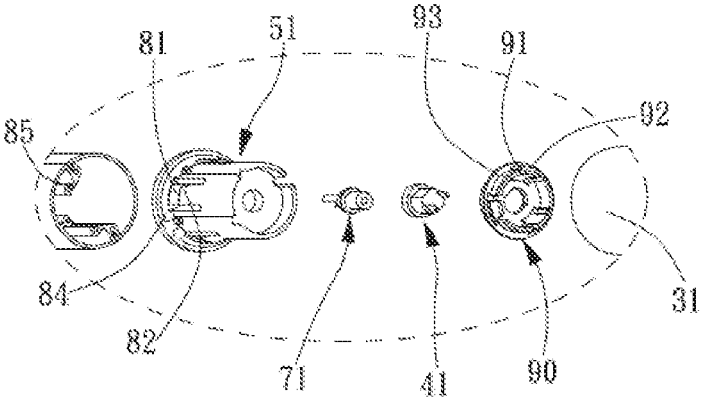
FIG. 5 is a enlarged view of circled portion V of FIG. 4.
Figure 6:
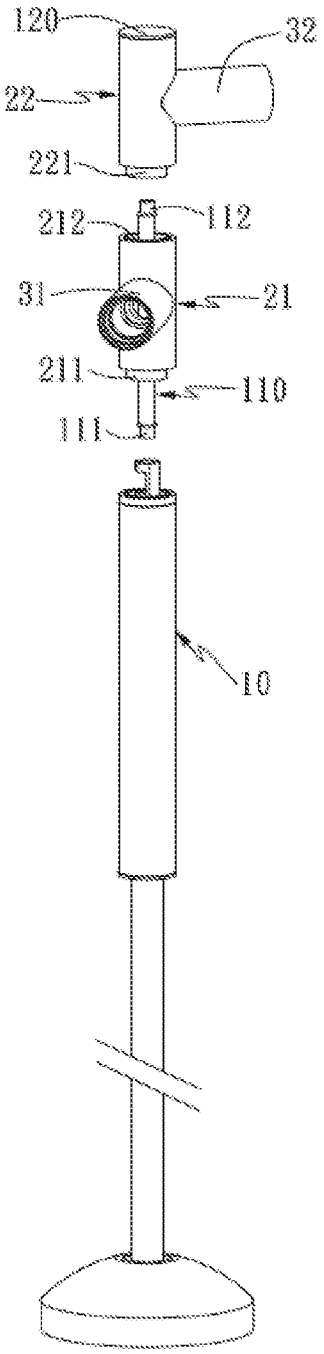
FIG. 6 is an exploded, schematic view of a portion of the LED lamp shown in FIG. 1.
Figure 7:
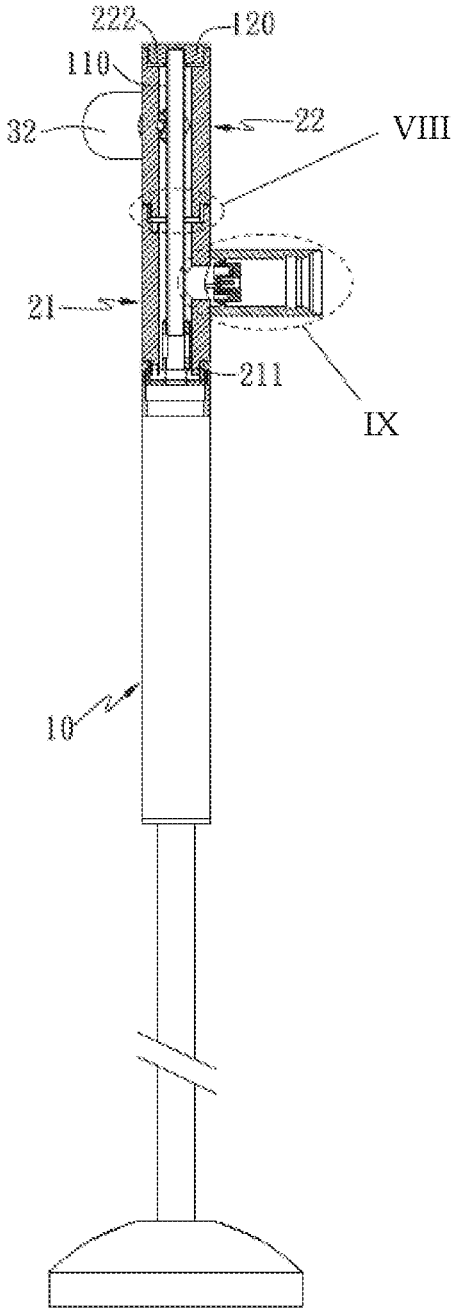
FIG. 7 is a cross sectional view of a portion of the LED lamp shown in FIG. 1.
Figure 8:
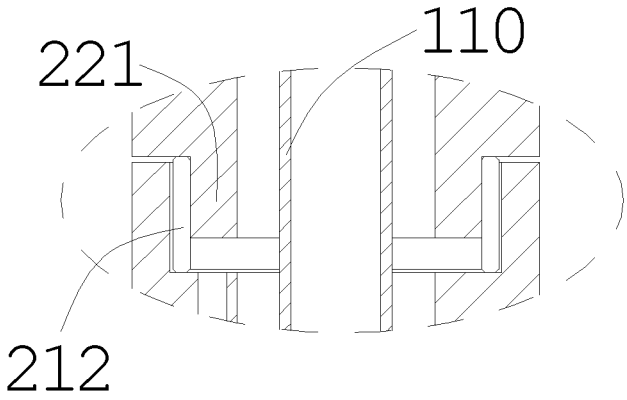
FIG. 8 is a enlarged view of circled portion VIII of FIG. 7.
Figure 9:
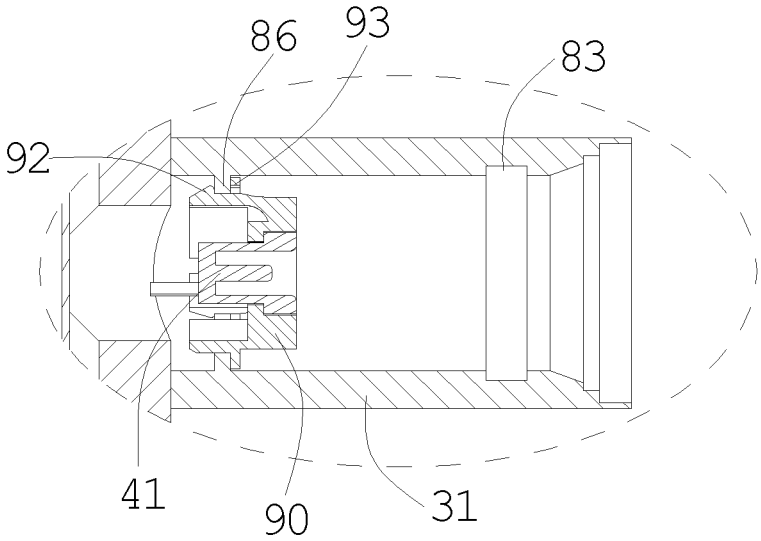
FIG. 9 is a enlarged view of circled portion IX of FIG. 7.
Figure 10:
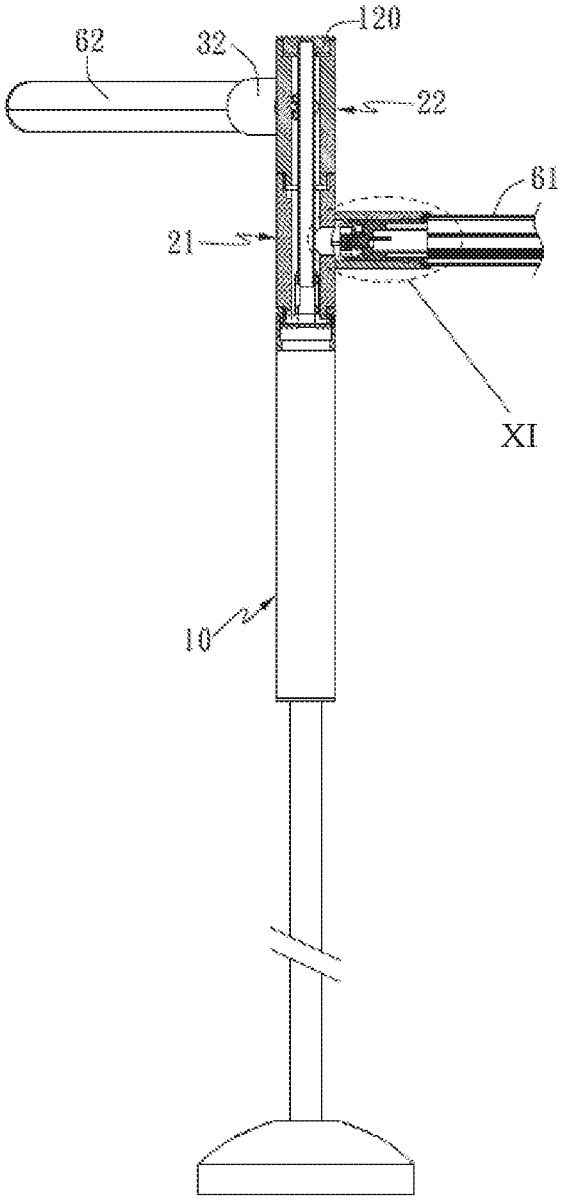
FIG. 10 is a cross sectional view of a portion of the LED lamp shown in FIG. 1.
Figure 11:
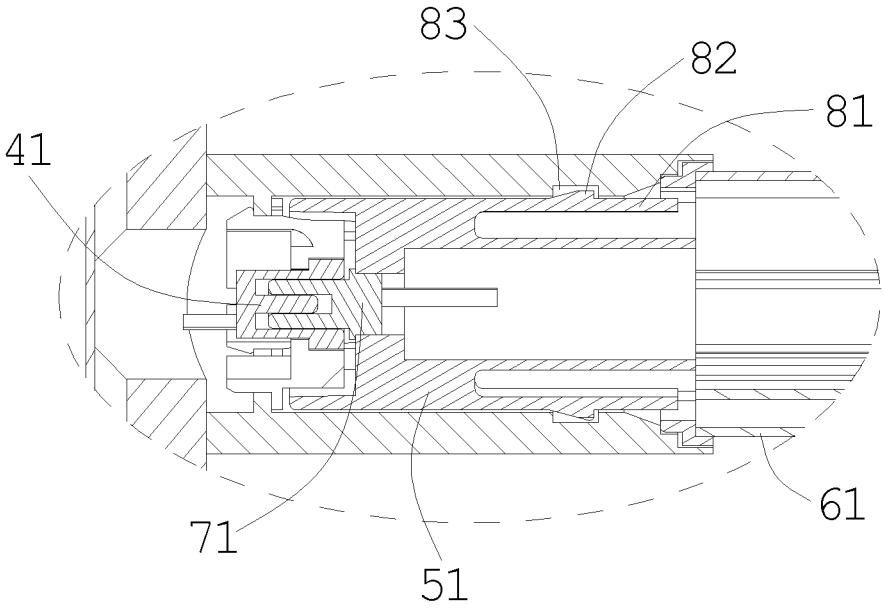
FIG. 11 is a enlarged view of circled portion XI of FIG. 10.
Figure 12:
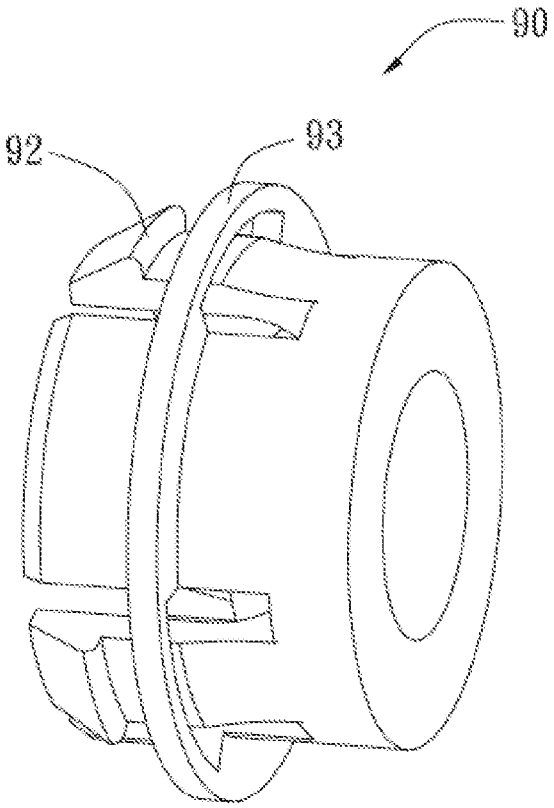
FIG. 12 is a schematic view of a connecting member shown in FIG. 2.

As shown in FIG. 1 through FIG. 12, a LED lamp 100 according to a preferred embodiment of the invention, includes: an assembly bracket 10, a first tube coupling 21, a second tube coupling 22, a first sleeve 31, a second sleeve 32, a first female joint 41, a second female joint (not shown), a first pluggable connector 51, a second pluggable connector (not shown), a first LED modulator tube 61, a second LED modulator tube 62, a first male joint 71, and a second male joint (not shown). The first tube coupling 21 and a second tube coupling 22 are rotatably connected to the assembly bracket 10. The first sleeve 31 is fixed to an outer wall of the first tube coupling 21, the second sleeve 32 is fixed to an outer wall of the second tube coupling 22. The first female joint 41 is positioned in the first sleeve 31, the second female joint (not shown) is positioned in the second sleeve 32. The first pluggable connector 51 is rotatably connected to the first sleeve 31, and the second pluggable connector is rotatably connected to the second sleeve 32. The first LED modulator tube 61 is connected to the first pluggable connector 51, the second LED modulator tube 62 is connected to the second pluggable connector. The first male joint 71 is positioned in the first pluggable connector 51 and is plugged into the first female joint 41, and the second male joint is positioned in the second pluggable connector and is plugged into the second female joint. According to a requirement of practical application, the number of above described tube couplings can be one, three, four and more, when the number of the tube couplings are more than two, the plurality of tube couplings are connected to each other by a head to tail types similar to that of the first tube coupling 21 and the second tube coupling 22. In the other embodiments, each tube coupling can be firmly provided with two or three sleeves.

In order to simply illustrate the invention, the structures and connection types of the first tube coupling 21, the first sleeve 31, the first female joint 41, the first pluggable connector 51, the first LED modulator tube 61, and the first male joint 71 are illustrated in the following for the purpose of example.

The outer wall of the first pluggable connector 51 is provided with a plurality of clips 81 extending along a direction toward the first LED tube 61. The clip 81 is provided with a protrusion 82. The first sleeve 31 defines an annular groove 83 in an inner wall thereof, causing the protrusion 82 to be latched in the annular groove 83 and avoiding the first pluggable connector 51 easily disengaging from of the first sleeve 31, when the first pluggable connector 51 extends into the first sleeve 31, and simultaneously, the first LED tube 61 which is connected to the first pluggable connector 51 rotating along the first sleeve 31 for 360 degrees can be achieved. Therefore, the light emitting direction of the first LED tube 61 can be adjusted flexibility according to a requirement, and the dismantle of the first pluggable connector 51 and the first LED tube 61 is simple. Further, an angle between the first LED tube 61 and the second LED tube 62 can be adjusted by virtue of the first tube coupling 21 and the second tube coupling 22 which are rotatably connected to the assembly bracket 10, it is easy for the LED lamp 100 to perform a modeling transformation.

Specifically, in the embodiment, the first pluggable connector 51 is provided with a base plate 84 at an end adjacent to the first LED tube 61. The first LED tube 61 is provided with a support 85, the support 85 is positioned along a longitudinal direction of the first LED tube 61. The base plate 84 is detachably connected to the support 85 via screws, bolts and such threaded fasteners. In other embodiments, the first LED tube 61 and the first pluggable connector 51 are integrally formed.

In order to firmly assembly and dismantle the first female joint 41, the first sleeve 31 is provided with a connector 90 therein. The first female joint 41 is positioned in the connector 90. The first sleeve 31 is provided with an annular portion 86 protruding from an inner wall thereof. An outer wall of the connector 90 is provided with a plurality of elastic arms 91 extending from an outer wall of the connector 90. The elastic arm 91 has an anti-detachment barb 92. The connector 90 further has a resisting portion 93 protruding from the outer wall. In the embodiment, the resisting portion 93 has an annular shape surrounding the outer wall of the connector 90, thus when the connector 90 extends into the first sleeve 31, the annular portion 86 is latched between the anti-detachment barb 92 and the resisting portion 93, thereby preventing the connector 90 from disengaging from an inner of the first sleeve 31. In a practical application, firstly, the first female joint 41 are connected to the connector 90 by threaded connection or by interference fit or by interference latch, and then the connector 90 extends into the first sleeve 31, achieving a convenient assembly and dismantle of the first female joint 41.

With regard to the connecting type of the plurality of tube couplings rotatably connected to the assembly bracket 10, the first tube coupling 21 and the second tube coupling 22 are illustrated exemplary.

In the embodiment, the LED lamp 100 further includes a supporting rod 110 and a locking nut 120. The supporting rod 110 includes a first end 111 and a second end 112 positioned opposite to the first end 111. The first end 11 of the supporting rod 110 is detachably connected to the assembly bracket 10. The first tube coupling 21 and the second tube coupling 22 are sequentially sleeved on the supporting rod 110. The first tube coupling 21 is provided with a first pluggable connecting portion 211 extending from an end of the first tube coupling 21. The first pluggable connecting portion 211 surrounds a central axis of the first tube coupling 21. The first tube coupling 21 defines a first containing groove 212 at an opposite end. The second tube coupling 22 is provided with a second pluggable connecting portion 221 extending from an end of the second tube coupling 22. The second pluggable connecting portion 221 is positioned around a central axis of the second tube coupling 22. The second tube coupling 22 defines a second containing groove 222 at an opposite end. The second pluggable connecting portion 221 of the second tube coupling 22 is rotatably plugged into the first containing groove 212 of the first tube coupling 21. The locking nut 120 covers in the second containing groove 222 of the second tube coupling 22, and the locking nut 120 resists the second end 112 of the supporting rod 110, thereby avoiding the first tube coupling 21 and the second tube coupling 22 disengaging from the supporting rod 110.

By virtue of the plurality of tube couplings which are connected to the assembly bracket, it is easy to perform a modeling transformation to the LED lamp 100, and by virtue of the pluggable connector which is rotatably connected to the sleeve, the LED tube which is connected to the pluggable connector rotating along the sleeve for 360 degrees can be achieved. The light emitting direction of the LED tube can be adjusted flexibility according to a requirement, and disengage of the pluggable connector and the LED tube is simple.

Although the invention is illustrated and described herein with reference to specific embodiments, the invention is not intended to be limited to the details shown. Rather, various modifications may be made in the details within the scope and range of equivalents of the claims and without departing from the invention. The scope of the invention is set forth in the following claims along with their full scope of equivalents.

What is claimed is:

1. A LED lamp, comprising:

a sleeve;

a female joint received in the sleeve;

a pluggable connector rotatably connected to the sleeve;

a LED tube connected to the pluggable connector; and a male joint received in the pluggable connector and engaging the female joint;

wherein the pluggable connector is provided with a plurality of clips on an outer sidewall thereof extending towards the LED tube, each clip is provided with a protrusion, the sleeve defines an annular groove on an inner wall thereof, the protrusion is latched in the annular groove when the pluggable connector is inserted into the sleeve, thereby preventing the pluggable connector from disengaging from the sleeve.

2. The LED lamp according to claim 1, further comprising a connector positioned in the sleeve, wherein the female joint is positioned in the connector, the sleeve is provided with an annular portion on an inner wall thereof, the connector is provided with a plurality of elastic arms extending from an outer wall thereof, the elastic arm is provided with an anti-detachment barb, the connector is further provided with a resisting portion protruding from the outer wall thereof, such that the annular portion is latched between the anti-detachment barb and the resisting portion when the connector is inserted into the sleeve.

3. The LED lamp according to claim 2, wherein the resisting portion has an annular shape and surrounds the outer wall of the connector.

4. The LED lamp according to claim 1, wherein the pluggable connector is provided with a base plate at an end thereof adjacent to the LED tube, the LED tube is detachably connected to the base plate.

5. The LED lamp according to claim 4, wherein the LED tube is provided with a support at an inner wall thereof extending along a longitudinal direction of the LED tube, the base plate is detachably connected to the support via threaded fasteners.

6. A LED lamp, comprising:

an assembly bracket;

a plurality of tube couplings rotatably connected to the assembly bracket;

a sleeve fixed to an outer wall of the tube coupling;

a female joint received in the sleeve;

a pluggable connector rotatably connected to the sleeve;

a LED tube connected to the pluggable connector; and a male joint received in the pluggable connector and engaging the female joint;

wherein the pluggable connector is provided with a plurality of clips at an outer wall thereof extending toward the LED tube, each clip is provided with a protrusion, the sleeve defines an annular groove in an inner wall thereof, the protrusion is latched in the annular groove when the pluggable connector is inserted into the sleeve, thereby preventing the pluggable connector from disengaging from the sleeve.

7. The LED lamp according to claim 6, further comprising a supporting rod and a locking nut, wherein the supporting rod comprises a first end and a second end positioned opposite to the first end, the first end is detachably connected to the assembly bracket, the plurality of tube couplings are sequentially sleeved on the supporting rod, the locking nut is located on the tube coupling away from the assembly bracket, and the locking nut resists the second end.

8. The LED lamp according to claim 7, wherein at least one tube coupling is provided with a pluggable connecting portion extending from an end of the tube coupling, the pluggable connecting portion surrounds a central axis of the tube coupling, the tube coupling defines a containing groove at an opposite end, the pluggable connecting portion of the tube coupling rotatably extends into the containing groove of an-adjacent tube coupling.

* * * * *